United States Patent [19]

Pan

[11] 4,211,987

[45] Jul. 8, 1980

[54] CAVITY EXCITATION UTILIZING MICROSTRIP, STRIP, OR SLOT LINE

[75] Inventor: Jing-Jong Pan, Melbourne, Fla.

[73] Assignee: Harris Corporation, Melbourne, Fla.

[21] Appl. No.: 856,037

[22] Filed: Nov. 30, 1977

[51] Int. Cl.[2] ..... H01P 7/06; H01P 5/00

[52] U.S. Cl. ..... 333/230; 333/246

[58] Field of Search ..... 333/82 R, 82 B, 83 R, 333/84 M, 219, 230, 246

[56] References Cited

U.S. PATENT DOCUMENTS

| | | | |
|---|---|---|---|
| 2,976,499 | 3/1961 | Sferrazza | 333/84 M X |
| 2,984,802 | 5/1961 | Dyer et al. | 333/73 S |
| 3,621,367 | 11/1971 | Rosen et al. | 333/84 M UX |
| 3,771,075 | 11/1973 | Phelan | 333/84 M |
| 3,786,371 | 1/1974 | Hadbavny et al. | 333/83 R X |
| 3,842,360 | 10/1974 | Dickens | 333/82 B X |

*Primary Examiner*—Paul L. Gensler

*Attorney, Agent, or Firm*—Craig & Antonelli

[57] ABSTRACT

The excitation or coupling of microwave integrated circuits to a cavity or resonator is effected by a substrate forming part of the wall of the cavity and on which there is disposed a microstrip or a strip or a slot line.

15 Claims, 13 Drawing Figures

Figure 3A:
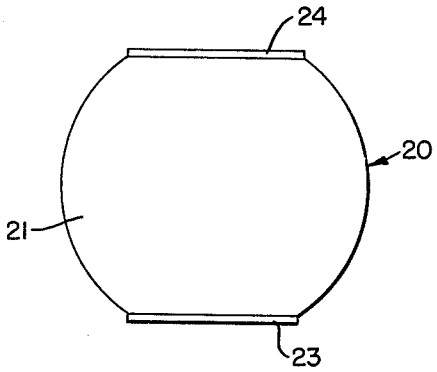

FIG. 1a.
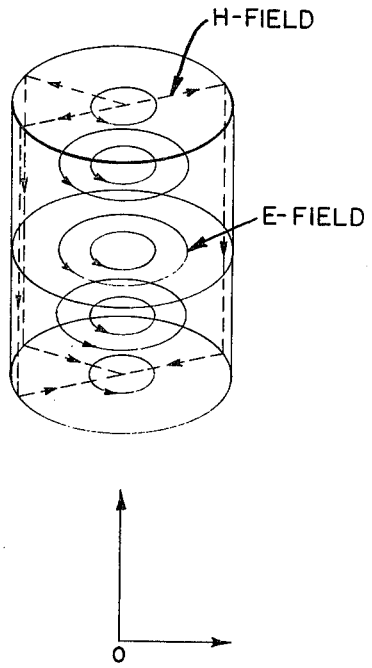
FIG. 1b
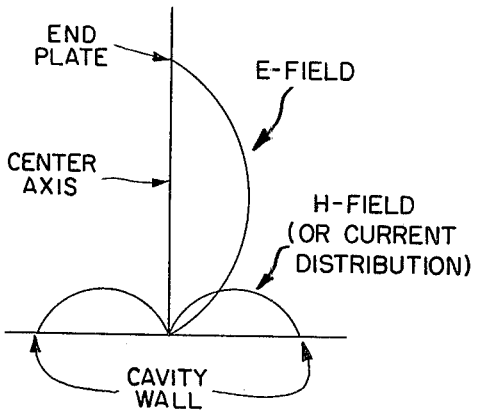
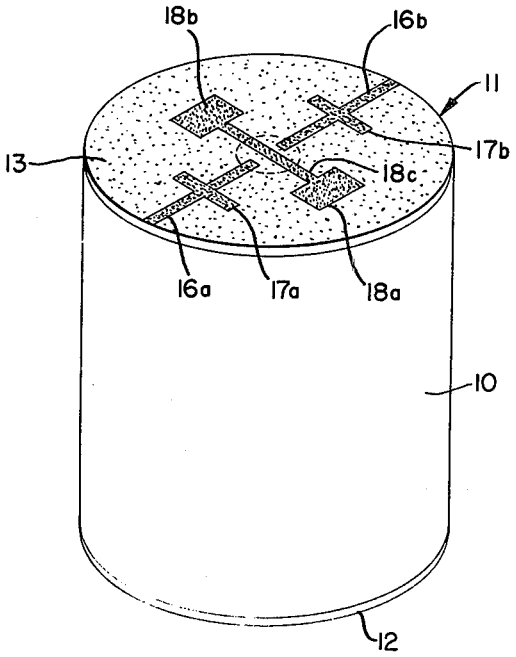
FIG. 2a.
FIG. 2b.
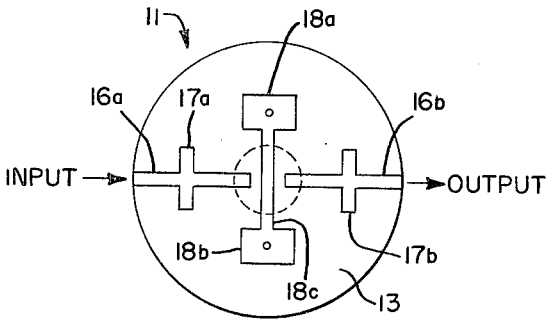
FIG. 2c.
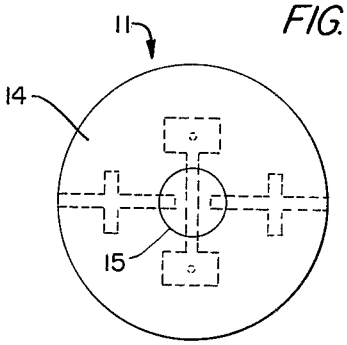

CAVITY EXCITATION UTILIZING MICROSTRIP, STRIP, OR SLOT LINE

The present invention relates to the excitation or coupling of microwave integrated circuits to a coaxial, rectangular, or circular cylindrical cavity or resonator utilizing a microstrip, a strip, or a slot line either from cavity sidewalls or the end plates thereof.

Conventional methods of cavity excitation include the use of probe antennas, loop antennas, and irises in the case of waveguide coupling; however, these conventional approaches to cavity excitation have inherent disadvantages which have rendered their use undesirable for certain applications. For example, in the case of high performance oscillators, narrow band band-pass or band-rejection filters, discriminators and phased array antenna systems, the conventional methods of cavity excitation provide unacceptable instability and distortion, leading to degradation of performance. In addition, these conventional methods also often involve complicated structures for interfacing microwave integrated circuits with waveguides and cavities resulting in increased production costs and difficulty in maintaining a high quality of production.

In the case of probe or loop antennas, excitation of the cavity or resonator is subject to mechanical vibration, which becomes an especially serious problem for oscillator applications. The probe or loop tends to degrade the quality factor or Q of the resonator due to fields perturbation and provide relatively poor thermal expansion characteristics. In the case of waveguide coupling utilizing an iris, an extra transition is generally needed to interface the microwave integrated circuit to the cavity, thereby introducing insertion losses and discontinuity (VSWR) in the system.

Modern communication, signal processing, tracking and guidance systems require the use of a very stable, low noise, small size microwave oscillator; however, the conventional coupling approaches including probe and loop antennas can never achieve the mechanical stability required by such systems. The electromagnetic fields inside the cavity can be perturbated by the probe or loop and degrade the quality factor of the system. Consequently, the frequency modulation and phase noise of the oscillator tends to increase with systems utilizing these conventional coupling techniques.

Microwave integrated circuits have become more popular and are used to a greater extent in present-day microwave systems, but the use of such circuits is inhibited by the fact that the conventional microstrip-to-coaxial-to-cavity transition heretofore available has been found to be less than satisfactory, since it increases fabrication costs and results in generally poor performance of the system in which it is incorporated. The microstrip transmission line is widely used in the design of solid state microwave circuits today; however, it is difficult to achieve the goal of high stability and low noise in integrated or hybrid circuits since the microstrip is a low-Q-transmission line. Therefore a high-Q resonator has to be utilized to stabilize the circuits, reduce the noise, and improve the filtering performances. The conventional methods of resonator coupling using a loop or probe antenna not only suffer from the instability resulting from mechanical vibration, but also require an extra transition between the microstrip and resonator which not only introduces additional insertion loss, but also increases the cost of fabrication.

It is therefore a principal object of the present invention to provide an arrangement for interfacing microwave integrated circuits with waveguides and cavities which will avoid the disadvantages and inherent drawbacks of the conventional approaches heretofore available.

It is another object of the present invention to provide a coupling arrangement of rather simple construction which is capable of exciting a cavity or transmission line with minimal distortion.

It is a further object of the present invention to provide a coupling arrangement which is capable of reducing high-Q oscillator instability due to mechanical vibration.

It is still another object of the present invention to provide a coupling arrangement which provides a significant cost savings in production, high reproducibility and enhanced performance for applications involving oscillators, filters and antennas.

In accordance with the present invention, the excitation or coupling of microwave integrated circuits to a coaxial, rectangular, or circular cylindrical cavity or resonator, either air-filled or dielectric-filled, is effected utilizing a microstrip, a strip or a slot line either from the cavity sidewalls or the end plates of the resonator. The coupling may be effected either by slot or by strip, and either approach can be applied either to the end plates or to the sidewall of the cavity or resonator. The novel approach provided by the present invention is also applicable to the excitation of waveguide transmission lines.

These and other objects, features, and advantages of the present invention will be more clearly set forth in the following detailed description of several embodiments of the present invention as illustrated in the accompanying drawings, wherein:

FIGS. 1*a* and 1*b* are diagrams illustrating the field distribution and field strength as a function of position, respectively, for the $TE_{011}$ mode;

FIG. 2*a* is a perspective view of a cavity resonator in accordance with a first embodiment of the present invention in which the cavity is excited from the top wall;

FIGS. 2*b* and 2*c* are top and bottom detail views, respectively, of the substrate forming the top wall in the embodiment of FIG. 2*a;*

Figure 3B:
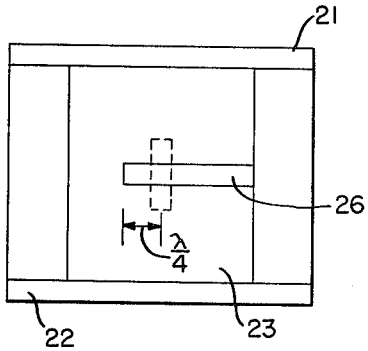

FIG. 3*a* is a top view of a cavity resonator in accordance with a second embodiment of the present invention in which the cavity is excited from the side wall;

FIG. 3*b* is a side view of the embodiment of FIG. 3*a;*

Figure 3C:
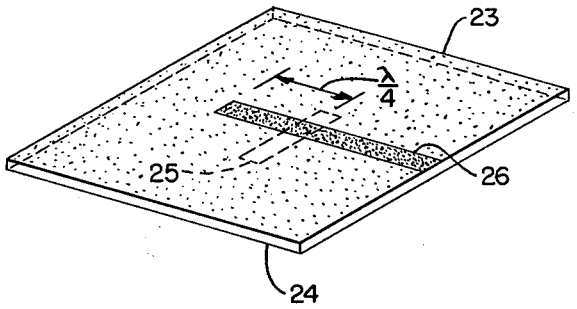

FIG. 3*c* is a detail view in perspective of the substrate forming part of the side wall in the embodiment of FIG. 3*a;*

Figure 4A:
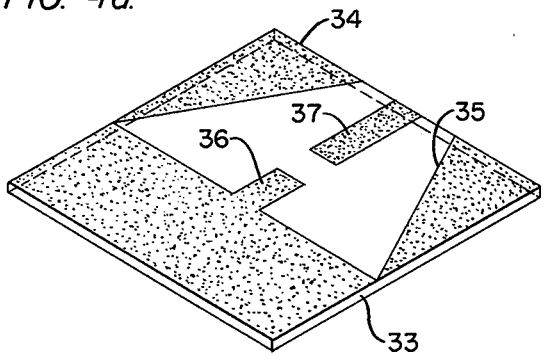
Figure 4B:
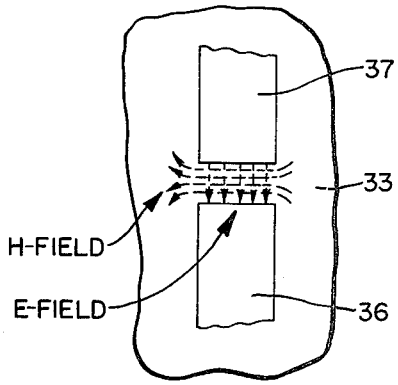

FIG. 4*a* is a detail view in perspective of another embodiment of a substrate which may form part of the side wall of a cavity;

FIG. 4*b* is a diagram illustrating the field patterns associated with the microstrip conductors in the embodiment of FIG. 4*a;*

Figure 5A:
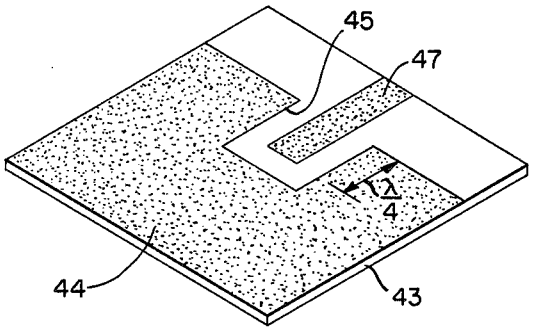
Figure 5B:
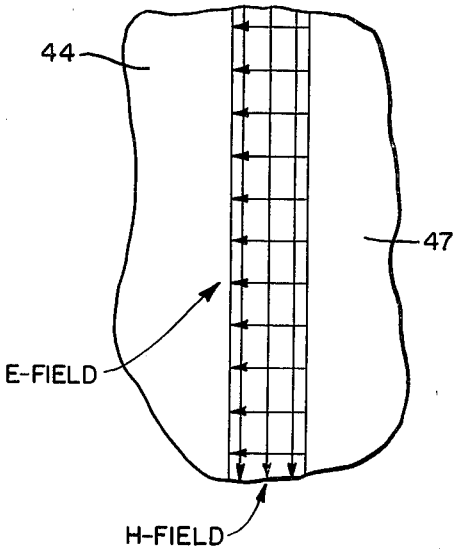
Figure 6:
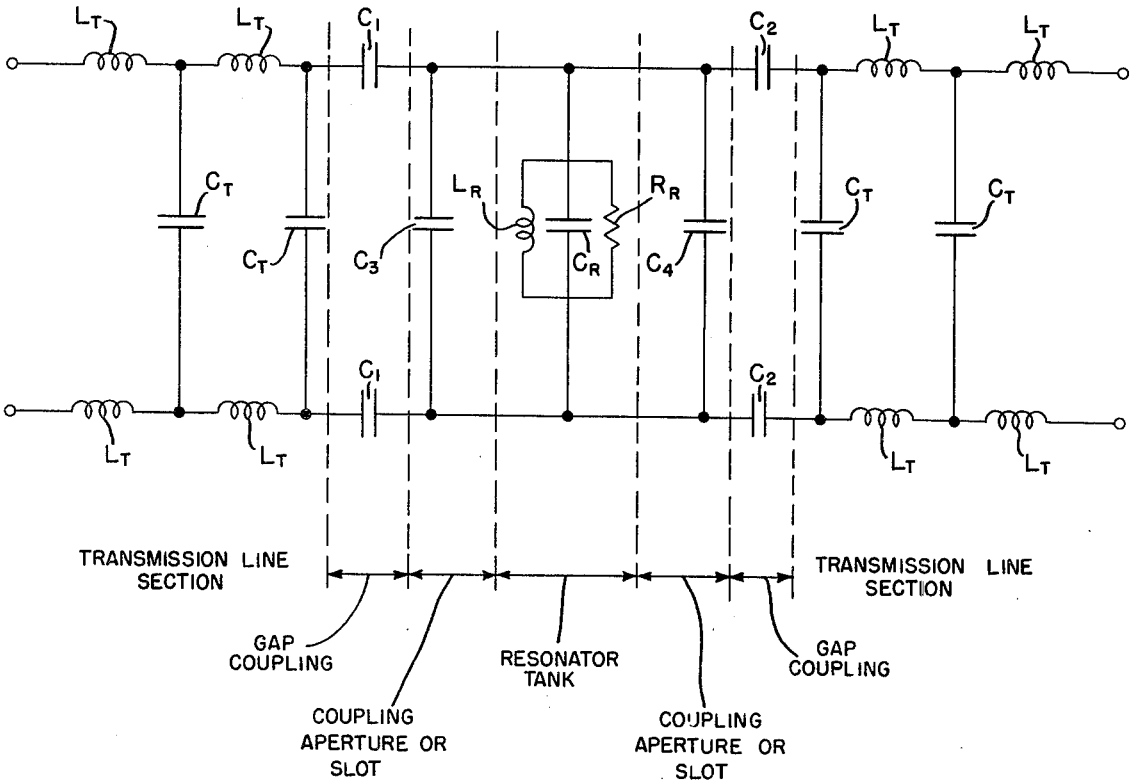

FIG. 5*a* is a detail view in perspective of still another embodiment of a substrate which may form part of the side wall of a cavity;

FIG. 5*b* is a diagram illustrating the field patterns associated with the microstrip conductors in the embodiment of FIG. 5*a;* and FIG. 6 is an equivalent circuit diagram of a coupling arrangement in accordance with this invention.

For convenience in describing the basic principles of the present invention, the following discussion relates specifically to the excitation of the $TE_{011}$ mode of the right circular cylindrical resonator. However, it will be appreciated from the following description that the same principles can apply equally to the excitation of $TE_{1mn}$ or $TEM_{1mn}$ modes in a circular cavity, rectangular cavity, coaxial cavity, heliax cavity and the like.

The field distribution of the $TE_{011}$ mode is illustrated in FIG. 1*a* and the field strength as a function of position is depicted in FIG. 1*b*. In accordance with the present invention, coupling to such a circular cylindrical resonator may be effected either by means of a slot or by means of a strip either from the cavity side walls or from the end plates. Based upon the field distribution and field strength characteristics of the $TE_{011}$ mode, as shown in FIGS. 1*a* and 1*b*, several exemplary embodiments of the present invention utilizing both slot and strip excitation at the end plates and the side walls will be described.

FIGS. 2*a*, 2*b*, and 2*c* illustrate a slot coupling arrangement in accordance with the present invention in connection with a right circular cylindrical resonator cavity 10 having a top end plate 11 and a bottom end plate 12, the cavity 10 being either air-filled or dielectric-filled. The top end plate 11 is provided in the form of a microstrip substrate 13, formed of suitable insulating material, on the inner side of which there is formed, such as by electro-plating, vacuum deposition, or other conventional means, a metallized ground plate 14 which covers the entire surface of the substrate 13 except for a slot 15 disposed in the center of the substrate. The slot 15, which is formed by chemical etching, masking, mechanical removal or other conventional means, may be circular as illustrated in FIG. 2*c*, or it may be of rectangular shape.

On the outer surface of the substrate 13 there is provided a pair of strip conductors 16*a* and 16*b*, which are positioned diametrically on the substrate with the ends being spaced in the region coextensive with the slot 15 in the metallized ground plate 14 on the opposite side of the substrate. Matching networks for the input and output strips 16*a* and 16*b*, respectively, are provided by the conductive transversely disposed strips 17*a* and 17*b* on the substrate 13; while, grounded shielding members 18*a* and 18*b*, which are connected to the metallized ground plane 14 on the opposite side of the substrate 13, are interconnected by a conductive strip 18*c* disposed between the input and output strips 16*a* and 16*b* transversely across the area above the slot 15 in the metallized ground plane 14.

Input energy by which the cavity 10 is excited is supplied via the input microstrip 16*a* and energy from the excited cavity 10 is supplied from the output microstrip 16*b*. The conductive strip 18*c* interconnecting the grounded shielding members 18*a* and 18*b* extends across the slot 15 at the node in the field pattern, as seen in FIG. 1*b*, facilitating the excitation of the cavity 10 and the extraction of energy therefrom by way of the slot 15. In this regard, it will be noted that the interface arrangement provided in accordance with the present invention is not at all susceptible to mechanical vibration, is simple and inexpensive to manufacture, and has a high reproducibility.

Another embodiment of a cavity resonator providing for slot excitation in accordance with this invention is illustrated in FIGS. 3*a* and 3*b*. A right circular cylindrical resonator cavity 20, including a top end plate 21 and a bottom end plate 22, has part of its sidewall formed by a planar insulating substrate 23. Diametrically opposite the substrate 23 a conducting plate 24, similar in size and shape to the substrate 23, forms part of the side wall and maintains the symmetry of the cavity. As seen in FIG. 3*c*, the substrate 23 has a metallized ground plane 24 covering the entire inner surface thereof except for a rectangular slot 25, which may be formed by chemical etching, mechanical removal or other conventional means. An input conductive microstrip 26 is plated deposited or otherwise provided on the outer surface of the substrate 23 with the end thereof extending a quarter wavelength beyond the center line of the slot 25 in the metallized ground plane 24.

In order to reduce the undesired radiation, it is preferred to short the end of the microstrip 26 to the ground plane 24 because the short termination will radiate less energy than an open circuit arrangement for the microstrip. Energy is then coupled to the cavity or extracted therefrom via the microstrip 26 in the known manner.

Excitation of a cavity may be effected by means of a strip, as well as a slot, either from the sidewall or from the end plates. In the embodiment illustrated in FIG. 4*a*, a serial line coupling is provided by an insulating substrate 33 designed to form a portion of the side wall of a right circular cylindrical resonator cavity in the manner of substrate 23 of the cavity 20 in FIG. 3*a*. The outer surface of the substrate 33 is provided with a metallized ground plane 34 having a truncated triangular cut-out portion 35, again provided by etching, masking or other conventional means. In the cut-out portion 35 there is provided on the substrate a pair of opposed spaced conductive microstrips 36 and 37, which provide for the coupling of energy into the cavity and the extraction of energy therefrom. The field distributions of the H field and the E field are illustrated diagrammatically in FIG. 4*b*.

Another embodiment of the present invention providing for strip excitation from the side wall of a resonator is illustrated in FIG. 5*a* in the form of a substrate 43 designed to form a portion of the side wall of the resonator in the manner illustrated in FIG. 3*b*. The substrate 43 has a metallized ground plane 44 disposed thereon, including a cut-out portion 45 into which a conductive microstrip 47 projects from one edge of the substrate 43, by a distance of $\lambda/4$.

Coupling into the resonator cavity is effected in the embodiment of FIG. 5*a* by parallel line coupling, the E field and H field between the conductive microstrip 47 and the metallized ground plane 44 being illustrated in FIG. 5*b*.

The equivalent circuit depicting the coupling of a transmission line to a cavity by a slot or strip in accordance with this invention is illustrated in FIG. 6. The transmission line sections including the transition are formed by the inductances $L_T$ and $C_T$; while, the resonator tank is formed by the parallel combination of inductance $L_R$, capacitance $C_R$ and the resistance $R_R$. The capacitances $C_1$ and $C_2$ are contributed by the microstrip coupling gaps, and the capacitances $C_3$ and $C_4$ are contributed by the input iris and output iris on the resonator side wall, respectively.

The values of the capacitances $C_1$ and $C_2$ due to the microstrip coupling gaps may be calculated in accordance with the known characteristics of fields between equal semi-infinite rectangular electrodes and magnetic pole pieces on which is based the equations discussed in the article by S. B. Cohn in the IRE Transactions on MTT, entitled "Thickness Corrections for Capacitive Obstacles and Strip Conductors", Nov., 1960, pages 638–644. The capacitances $C_3$ and $C_4$, which are contributed by the input and output irises, depend on the aperture configuration to a large extent. A theoretical study of such apertures is discussed in the article by S. B. Cohn in the Proceedings of the IRE, entitled "Determination of Aperture Parameters by Electrolytic Tank Measurements", Nov., 1951, pages 924–930.

In each of the embodiments of the present invention disclosed herein, it is apparent that coupling is effected without the use of probe or loop antennas or other mechanical arrangements which are susceptible to mechanical vibration. Accordingly, it is apparent that the present invention provides a satisfactory interface for microwave integrated circuits with waveguides and resonant cavities, providing improved performance and stability with lower fabrication costs and enhanced reproducibility.

While the substrates which form part of the side walls of the resonators in the embodiments of FIGS. 3, 4, and 5 have been shown as having a planar configuration, it will be appreciated that these substrates could be curved to correspond to the cylindrical configuration of the cavity, or it could be formed as an integral part of the cavity wall. In addition, it should be apparent that the ground plane formed on one surface of the substrate is in electrical contact with the walls of the cavity to provide a continuous conductive surface therewith in each of the disclosed embodiments.

Although the embodiments of FIGS. 4*a* and 5*a* provide for coupling through the side wall of the cavity, it should be understood that these coupling methods may also be applied to the end wall of the cavity in the manner of the embodiment of FIG. 2*a*.

While I have shown and described several embodiments in accordance with the present invention, it is to be understood that the same is not limited thereto but is susceptible of numerous changes and modifications as known to a person skilled in the art, and I therefore do not wish to be limited to the details shown and described herein but intend to cover all such changes and modifications as are obvious to those of ordinary skill in the art.

What is claimed is:

1. An arrangement for excitation of a resonator comprising a resonant cavity, an insulating substrate forming at least a portion of a wall of said cavity, a conductive layer formed on the surface of said substrate inside said cavity, a slot being formed in said conductive layer, and coupling means mounted on the outer surface of said substrate for coupling energy through said slot into said cavity and for extracting energy from said cavity through said slot, and wherein said coupling means comprises a pair of coextensive conductive microstrips disposed on said substrate with the ends thereof positioned above the area of the slot in said conductive layer and being spaced by a predetermined amount.

2. An arrangement as defined in claim 1 wherein said cavity is a right circular cylinder and said substrate forms an end wall of said cavity.

3. An arrangement as defined in claim 1 wherein said cavity is a right circular cylinder and said substrate forms part of the side wall of said cavity.

4. An arrangement as defined in claim 3 wherein said substrate is planar.

5. An arrangement as defined in claim 1 wherein a further conductive strip is disposed on the outer surface of said substrate across the area above said slot and between the opposed ends of said conductive microstrips, said further conductive strips being connected through said substrate to said conductive layer on the inner surface of said substrate.

6. An arrangement for excitation of a resonator comprising a resonant cavity, an insulating substrate forming at least a portion of a wall of said cavity, a conductive layer formed on one surface of said substrate and having a cutout portion therein, and coupling means disposed on said one surface of said substrate and extending into said cutout portion for coupling energy to said cavity and extracting energy therefrom, and wherein said cutout portion is of truncated triangular configuration with the short base thereof adjacent one edge of the substrate.

7. An arrangement as defined in claim 6 wherein said coupling means comprises a first conductive strip extending from said one edge of said substrate and a second conductive strip coextensive with said first conductive strip and extending from said conductive layer with the end thereof spaced from the end of said first conductive strip by a predetermined amount.

8. An arrangement as defined in claim 7 wherein said cavity is a right circular cylinder and said substrate forms an end wall of said cavity.

9. An arrangement as defined in claim 7 wherein said cavity is a right circular cylinder and said substrate forms part of the side wall of said cavity.

10. An arrangement as defined in claim 9 wherein said substrate is planar.

11. An arrangement for excitation of a resonator comprising a resonant cavity, an insultating substrate forming at least a portion of a wall of said cavity, a conductive layer formed on one surface of said substrate and having a cutout portion therein, and coupling means disposed on said one surface of said substrate and extending into said cutout portion for coupling energy to said cavity and extracting energy therefrom, and wherein said conductive layer covers a portion of the surface of said substrate and said cutout portion is of rectangular configuration, said coupling means comprising a conductive strip extending from one edge of said substrate into said cutout portion and being spaced from said conductive layer by a predetermined amount.

12. An arrangement as defined in claim 11 wherein said conductive strip extends into said cutout portion by a quarter wavelength of the coupled energy.

13. An arrangement as defined in claim 11 wherein said cavity is a right circular cylinder and said substrate forms an end wall of said cavity.

14. An arrangement as defined in claim 11 wherein said cavity is a right circular cylinder and said substrate forms part of the side wall of said cavity.

15. An arrangement as defined in claim 14 wherein said substrate is planar.

* * * * *